US007367460B2

(12) United States Patent
Hirsch

(10) Patent No.: US 7,367,460 B2
(45) Date of Patent: May 6, 2008

(54) CUSTOMIZABLE DISPLAY UNIT

(75) Inventor: Donald A. Hirsch, Chicago, IL (US)

(73) Assignee: The Monster Company, Chicago, IL (US)

( * ) Notice: Subject to any disclaimer, the term of this patent is extended or adjusted under 35 U.S.C. 154(b) by 242 days.

(21) Appl. No.: 11/092,192

(22) Filed: Mar. 29, 2005

(65) Prior Publication Data

US 2006/0226100 A1 Oct. 12, 2006

(51) Int. Cl.
*A47F 3/14* (2006.01)

(52) U.S. Cl. ..... 211/126.1; 211/11

(58) Field of Classification Search ..... 211/11, 211/85.26, 88.01, 186, 90.01, 194, 113, 126.1, 211/126.2, 126.4, 126.13, 126.16, 128.1, 211/72, 133.1, 73, 10, 195; 206/745, 6.1, 206/501, 518, 558, 557, 561, 371
See application file for complete search history.

(56) References Cited

U.S. PATENT DOCUMENTS 1,501,770 A * 7/1924 Hanisch ..... 206/6.1
2,256,996 A * 9/1941 Bales ..... 108/101
3,207,321 A * 9/1965 Joyce ..... 211/126.5
3,425,594 A * 2/1969 Bridenstine ..... 206/507
3,429,427 A * 2/1969 Wolf ..... 206/214
3,860,309 A * 1/1975 Brendgord ..... 312/351
4,208,826 A * 6/1980 Lindaman ..... 43/57.1
4,228,906 A * 10/1980 Jones ..... 211/88.01
4,480,745 A * 11/1984 Loge et al. ..... 211/85.26
4,825,624 A * 5/1989 Calcerano ..... 206/745
5,299,690 A * 4/1994 Mund et al. ..... 206/503
5,657,880 A * 8/1997 Birnbaum ..... 211/50
5,683,003 A * 11/1997 Gebka ..... 211/57.1
5,836,455 A * 11/1998 Connor et al. ..... 206/757
6,105,796 A * 8/2000 Buchanan et al. ..... 211/128.1
6,955,268 B2 * 10/2005 Waldron ..... 211/51
2002/0190113 A1 * 12/2002 Holdsworth et al. ..... 229/164

* cited by examiner

*Primary Examiner*—Jennifer E. Novosad
(74) *Attorney, Agent, or Firm*—Neal, Gerber & Eisenberg LLP

(57) ABSTRACT

A customizable display rack for displaying a plurality of differently-sized products. The display rack is comprised of a housing with two opposing side walls, a rear wall and a front wall, each extending from a bottom wall to form an enclosed space that is accessible from at least one side, the front wall extending to a height that is substantially less than that of the rear wall. The housing is designed to accommodate a predetermined number of large trays, which may form a first row extending substantially the entire distance between each of two opposing side walls of the housing or a second row extending substantially the entire distance between the front wall and the rear wall of the housing. Each large tray may also be designed to accommodate a predetermined number of small trays. The display rack may also include a display holder.

10 Claims, 7 Drawing Sheets

14

CUSTOMIZABLE DISPLAY UNIT

BACKGROUND OF THE INVENTION

This invention relates generally to display units and more particularly to customizable display units for organizing consumer products.

Many display units have been developed to store and organize various consumer products, such as hair products, nail polish, tanning supplies and similar products. For example, display racks having several rows of shelves have been developed for allowing businesses to shelve their products while simultaneously displaying them to prospective customers. While these display racks work for their intended purpose, a continual need exists to develop better displays that are capable of storing products and presenting such products in a manner which is more appealing to their customers.

SUMMARY OF THE INVENTION

The present invention is directed to a customizable display rack for displaying a plurality of differently-sized products, the display rack comprising a housing with two opposing side walls, a rear wall and a front wall, each extending from a bottom wall to form an enclosed space that is accessible from at least one side, the front wall extending to a height that is substantially less than that of the rear wall. The housing is designed to accommodate a predetermined number of large trays, which may form a first row extending substantially the entire distance between each of two opposing side walls of the housing or a second row extending substantially the entire distance between the front wall and the rear wall of the housing. Each large tray may also be designed to accommodate a predetermined number of small trays. The display rack may also include a display holder.

A better understanding of the objects, advantages, features, properties and relationships of the invention will be obtained from the following detailed description and accompanying drawings which set forth illustrative embodiments that are indicative of the various ways in which the principles of the invention may be employed.

BRIEF DESCRIPTION OF THE DRAWINGS

For a better understanding of the invention, reference may be had to preferred embodiments shown in the following drawings in which.

DETAILED DESCRIPTION

Figure 1:
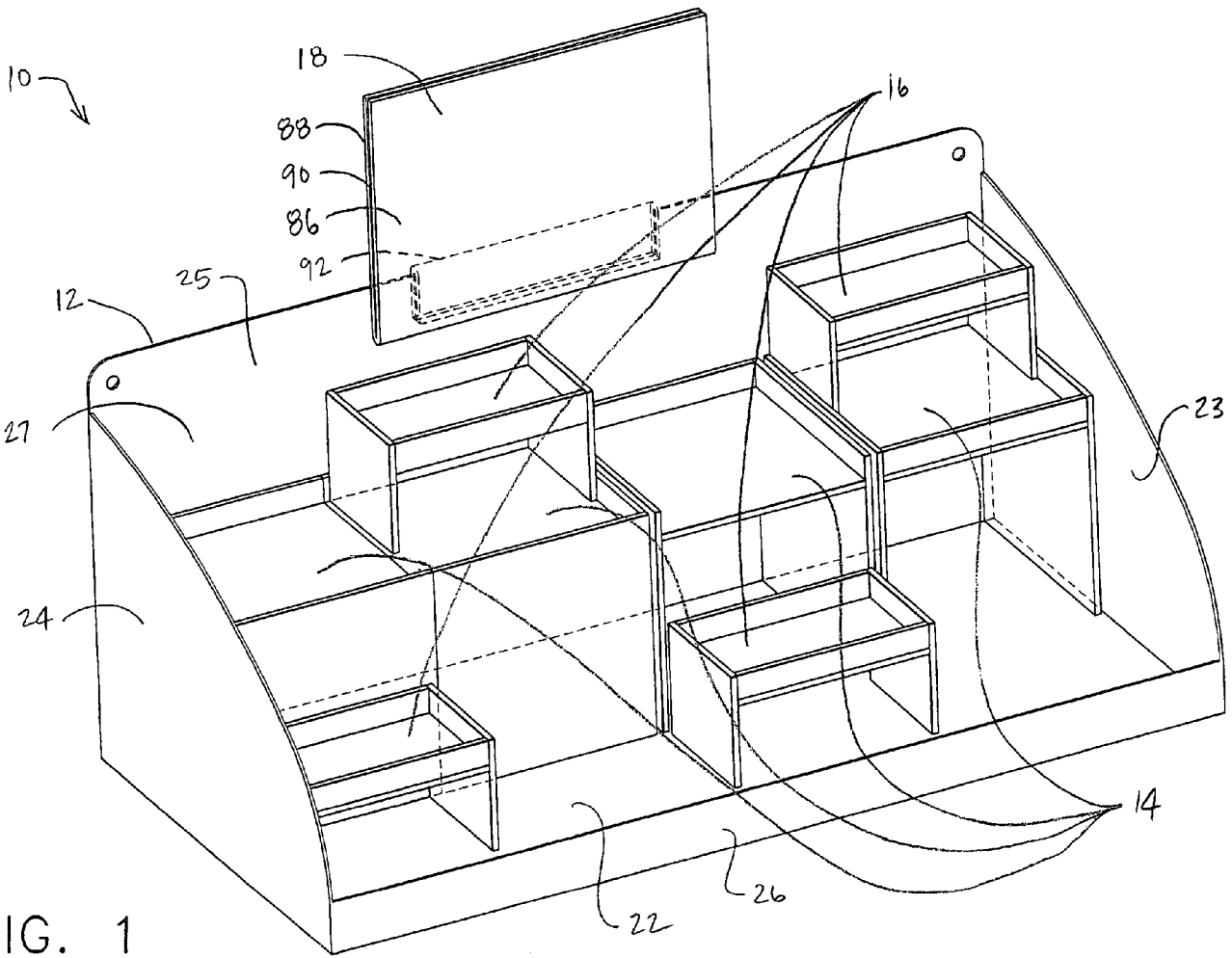
FIG. 1 illustrates a perspective view of a customizable display rack embodying the present invention in one of at least two display configurations.

While several embodiments of the present invention are shown in the drawings and described in detail, the present disclosure should be considered as an exemplification of the principles of the invention and is not intended to limit the invention to the embodiments so illustrated.

Turning now to the figures, wherein like reference numerals refer to like elements, there is illustrated a customizable display rack 10 embodying the present invention for displaying retail consumer products, such as tanning, hair care and cosmetic products, commonly sold at hair and beauty salons, department stores, and the like. Although it is likely that display rack 10 will be used as a point-of-purchase display, it should be understood that display rack 10 may also be used in other venues and for other purposes.

Figure 2:
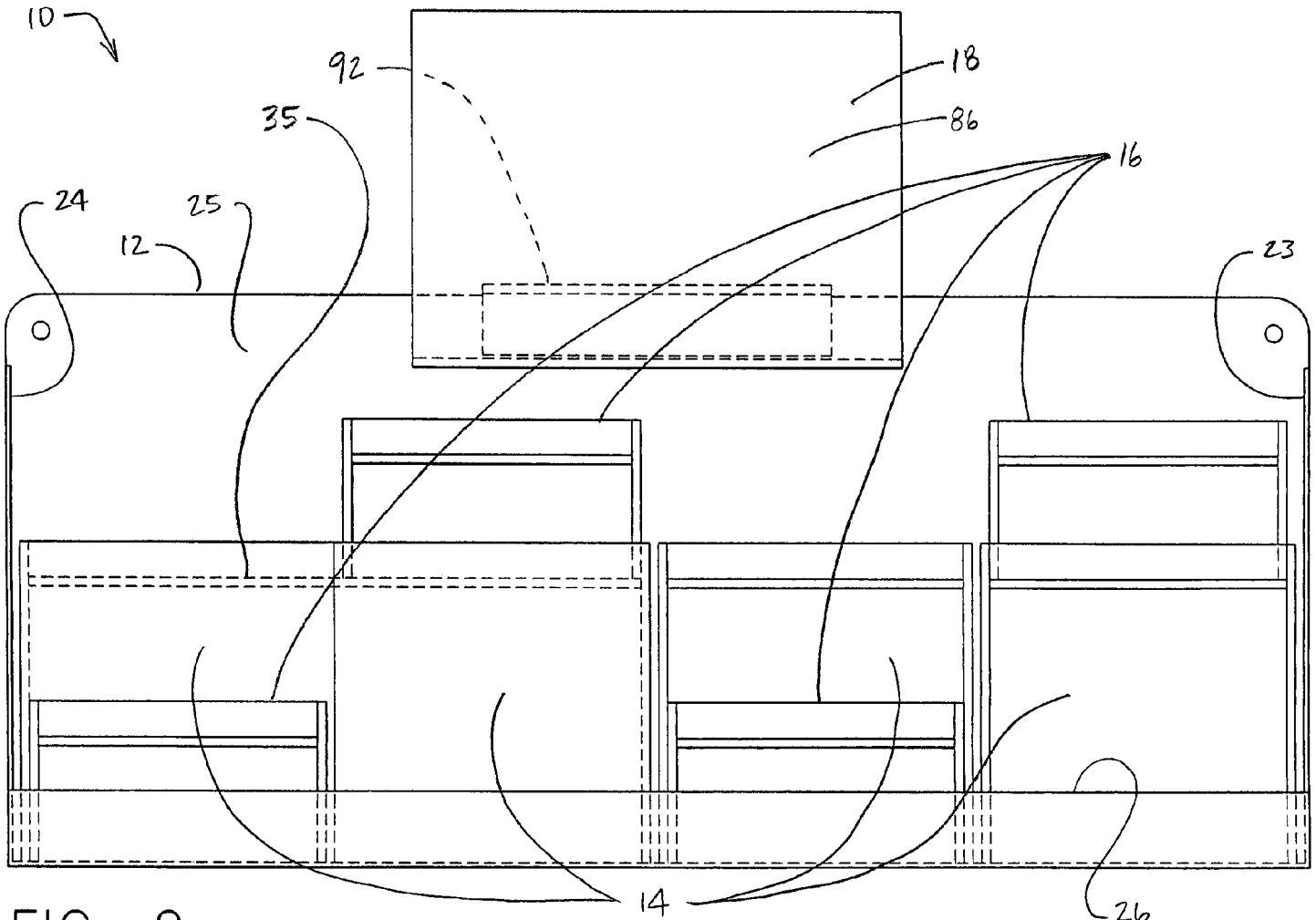
FIG. 2 illustrates a front view of the display rack shown in FIG. 1.
Figure 3:
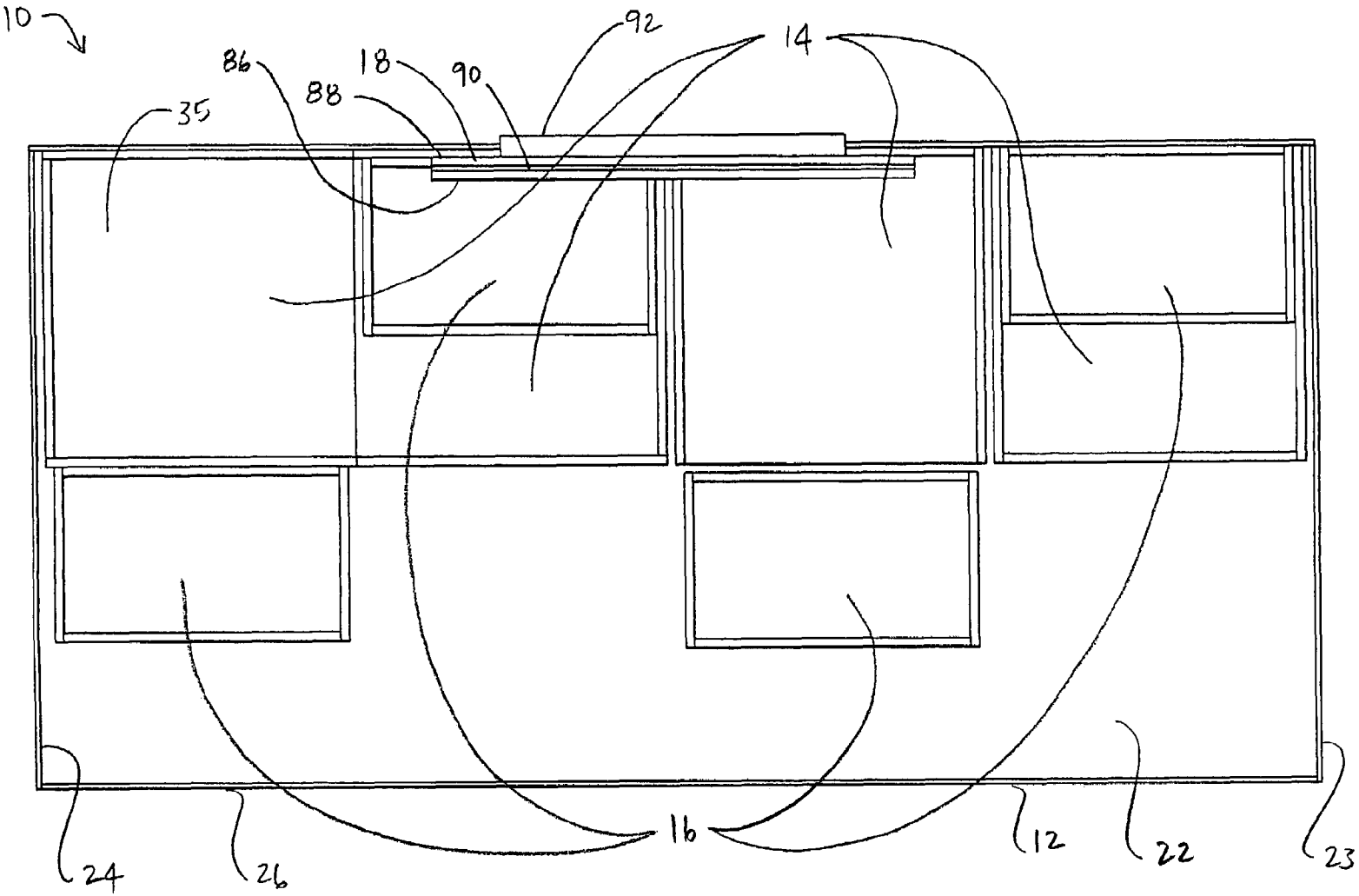
FIG. 3 illustrates a top view of the display rack shown in FIG. 1.
Figure 6:
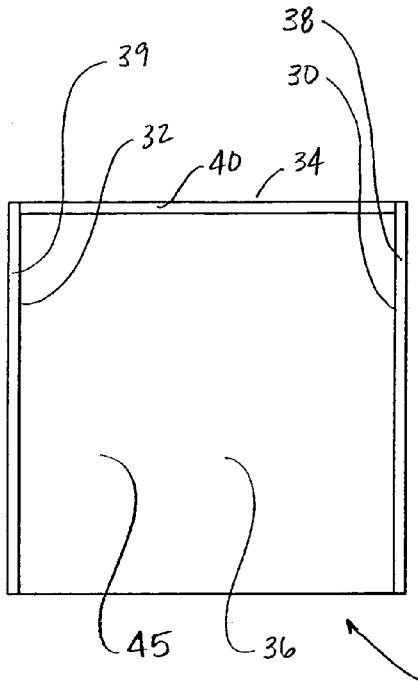
FIG. 6 illustrates a top view of the first tray shown in FIG. 4.
Figure 4:
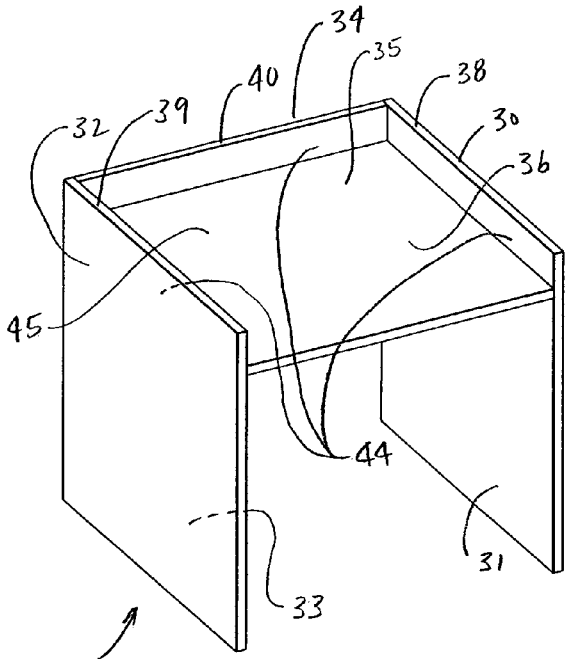
FIG. 4 illustrates a perspective view of a first tray, which is an element of the display rack shown in FIG. 1.
Figure 5:
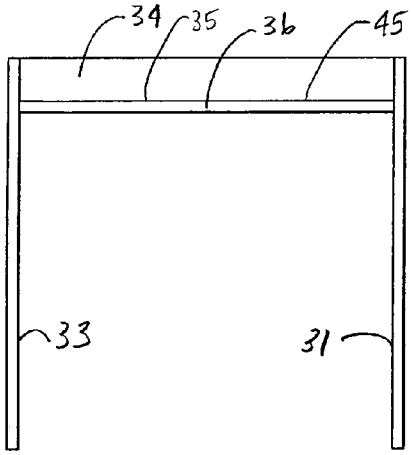
FIG. 5 illustrates a front view of the first tray shown in FIG. 4.
Figure 7:
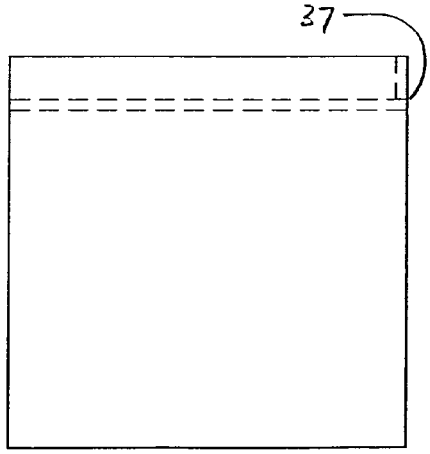
FIG. 7 illustrates a right side view of the first tray shown in FIG. 4.
Figure 8:
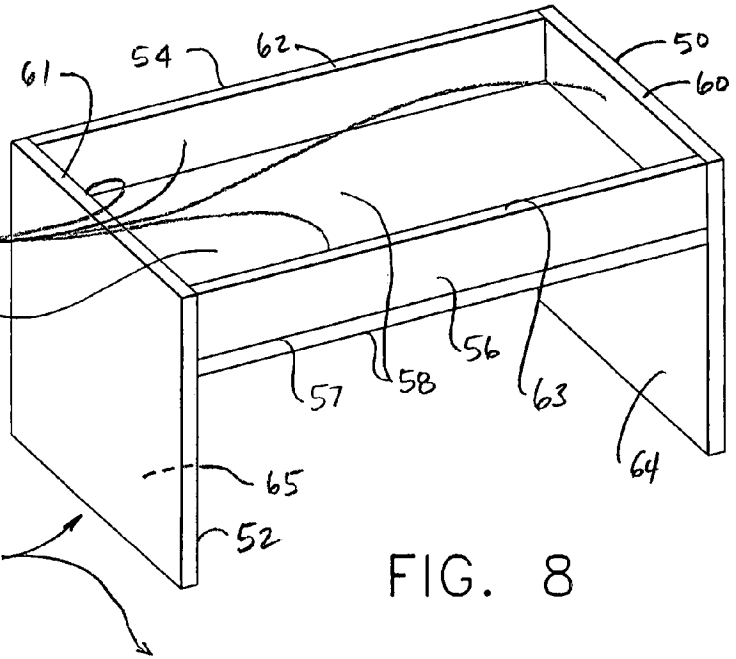
FIG. 8 illustrates a perspective view of a second tray, which is an element of the display rack shown in FIG. 1.
Figure 11:
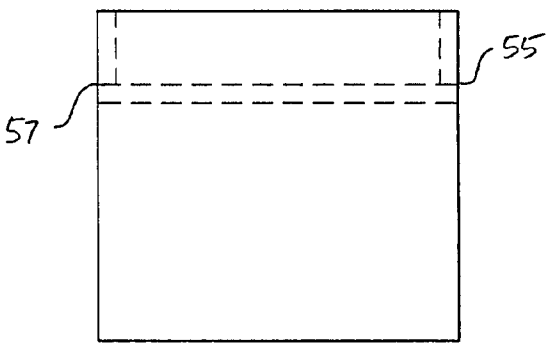
FIG. 11 illustrates a right side view of the second tray shown in FIG. 8.
Figure 10:
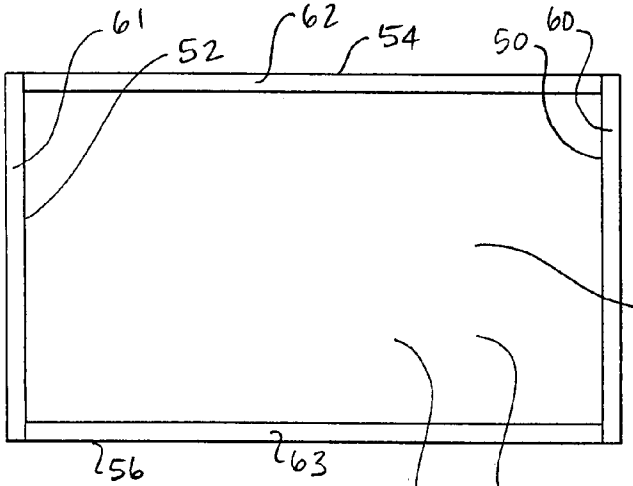
FIG. 10 illustrates a top view of the second tray shown in FIG. 8.
Figure 9:
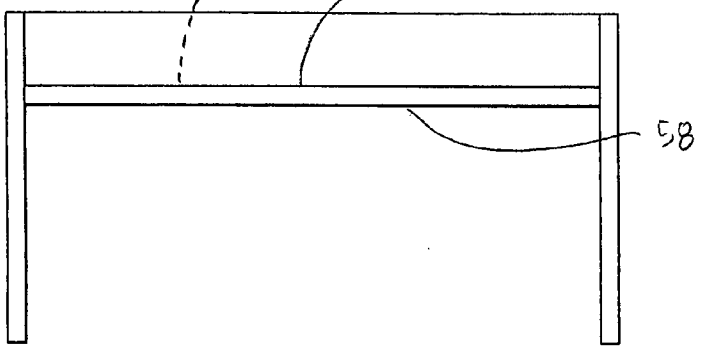
FIG. 9 illustrates a front view of the second tray shown in FIG. 8.

As will be understood by those skilled in the art, and as particularly illustrated in FIGS. 1-3, display rack 10 of the present invention is capable of many customizable configurations. One embodiment of display rack 10 includes housing 12, one or more large trays 14, one or more small trays 16, and display holder 18. Housing 12 may include, for example, bottom wall 22, two opposing side walls 23, 24, rear wall 25, and front wall 26 all connected together to form enclosed space 27 that is accessible from at least one side to facilitate access to, and manipulation of, the products on display. The products on display may be supported by housing 12, one or more of large trays 14, one or more of small trays 16, or any combination thereof.

As shown in FIGS. 1-3, display holder 18 may be configured to display an advertisement (not shown). Display holder 18 may be removably connected to rear wall 25 of housing 12, but may also be configured to be removably mounted to either of the two opposing side walls 23, 24 or to front wall 26 of housing 12. In particular, display holder 18 may include hanger 92 for mounting to housing 12, and may further include front panel 86 and rear panel 88 configured to form channel 90 therebetween for receiving and displaying an advertisement. Hanger 92 may be positioned on display holder 18 for placement of display holder 18 upright (as shown in FIGS. 1-3) or on its side.

For customizing the configuration of products supported by display rack 10, display rack 10 may include any combination of large trays 14 and small trays 16, or only large trays 14 or small trays 16. The number of large trays 14 and small trays 16 placed in housing 12 may be limited by the volume of housing 12 and the size of trays 14, 16. The size of large tray 14 may be designed to be a factor of the depth and/or width of housing 12 and to allow a predetermined number of large trays 14 to form a row that is substantially the same depth and/or width of housing 12. Likewise, the size of small tray 16 may be designed to be a factor of the depth and/or width of large tray 16 to allow a predetermined number of small trays 16 to form a row that is substantially the same depth and/or width of large tray 14. For example, small trays 16 may be designed to be approximately half the size of large tray 14 for nesting at least two small trays 16 within an enclosed space 41 formed as part of large tray 14, which will be discussed in greater detail below. Moreover, it should be appreciated by those with skill in the art that small trays 16 may be nested according to both the width and depth of large tray 14, and the size of small tray 16 may be designed to be a factor of the width and/or depth of housing 12 to form a row that is substantially the same depth and/or width of housing 12. When nested, a mild interference fit between small trays 16 and large tray 14 is permissible, but a slight clearance between the two components may also be employed.

Large trays 14 and small trays 16 may be individually fabricated in a multitude of shapes and sizes to accommodate a variety of products to be displayed. For example, large trays 14 and small trays 16 may, without limitation, be configured generally square, generally rectangular, both square and rectangular, or any other geometric shape capable of holding and displaying retail products and forming the desired nesting relationship with one another and with housing 12. As shown in FIGS. 1-3, large trays 14 and small trays 16 may be positioned in any one of a number of possible orientations to maximize a merchant's ability to display an array of products having a variety of sizes and shapes. For example and without intending to limit the invention, large trays 14 may be positioned on their side, upside down, or in any orientation within housing 12, so long as large trays 14 remain capable of supporting small trays 16 or products for display. In addition, small trays 16 may be positioned on their side, upside down, or in any orientation within housing 12 or on large trays 16 so long as small trays 16 remain capable of supporting products for display.

As shown in FIGS. 4-7, large tray 14 may include two opposing side walls 30, 32, a rear fence 34, and a base 36. Although right side wall 30, left side wall 32, and base 36 of large tray 14 are shown to be square in shape, each of the walls 30, 32 and base 36 may also be rectangular instead. Large tray 14 may be made of a semi-transparent plastic, but may also be made of any material so long as the chosen material provides sufficient rigidity and strength for its intended purpose, may be manufactured inexpensively, and remains visually appealing to customers.

In the embodiment shown in FIGS. 4-7, base 36 is connected substantially perpendicular to inside wall surfaces 31, 33 of right side wall 30 and left side wall 32, respectively. Rear fence 34 mounts to, and is substantially perpendicular to, top surface 35 of base 36 along rear edge 37 of base 36, and may also be affixed to each of right side wall 30 and left side wall 32. It should be understood, however, that rear fence 34 may only be affixed to one of the side walls 30, 32 or base 36, so long as rear fence 34 forms a substantially rigid barrier between side walls 30, 32.

As shown in FIGS. 4-7, base 36 may be vertically displaced a short distance from top surfaces 38, 39, 40 of each of right side wall 30, left side wall 32, and rear fence 34, respectively, to form three-sided lip 44. Base 36 together with three-sided lip 44 forms enclosed space 45, which is usable for supporting and displaying products. The distance between top surfaces 38, 39, 40 to base 36 may be varied to accommodate a wide range of product sizes.

Figure 12:
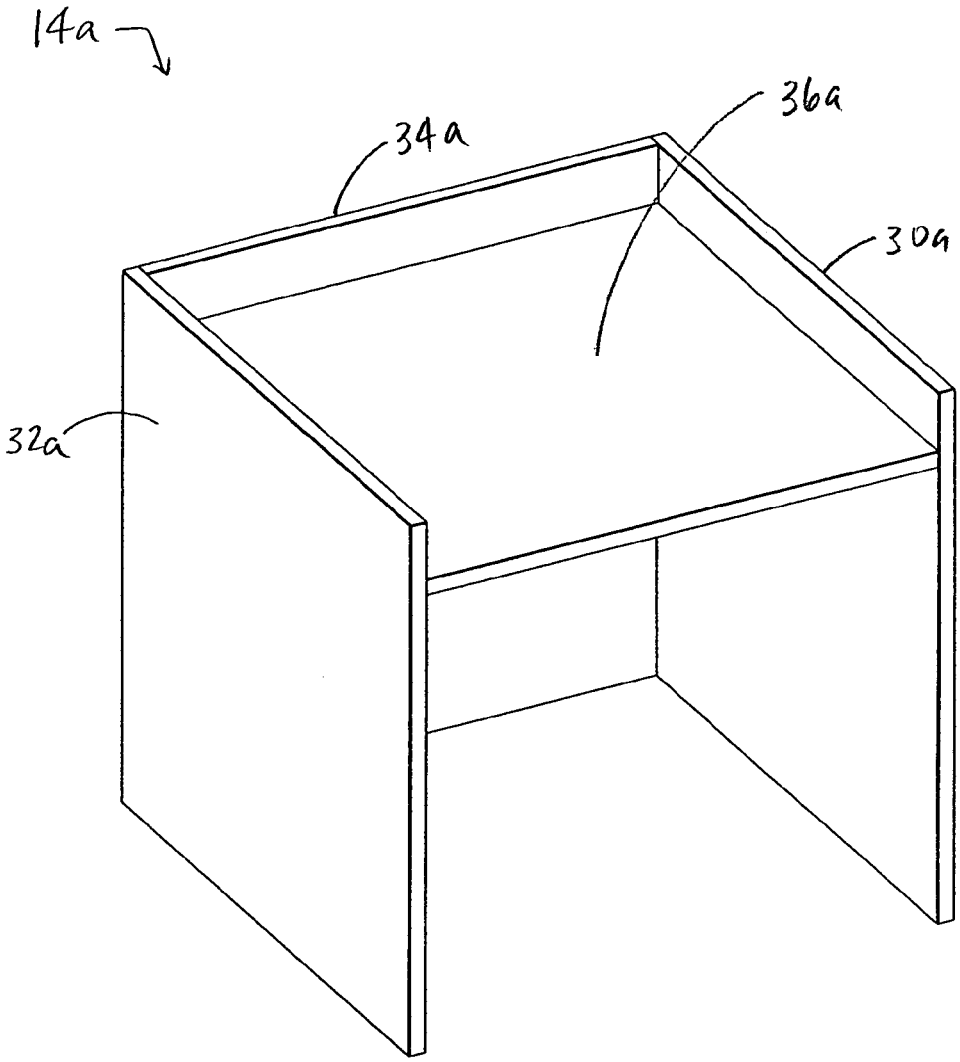
FIG. 12 illustrates an alternate embodiment of the first tray shown in FIG. 4.

Large tray 14 may optionally include a front wall (not shown). If present, a front wall may extend from top surfaces 38, 39, 40 to base 36 only, or it may extend past base 36 to have the same height as the two opposing sidewalls, 30, 32 thereby forming at least three legs upon which large tray 14 may stand. Likewise, as shown in FIG. 12, rear fence **34*a* of large tray 14*a* may extend past base 36*a* to have the same height as the two opposing sidewalls 30*a*, 32*a*. Rear fence 34*a* and front wall may also be of varying heights, so long as they do not exceed the height of the two opposing side walls 30*a*, 32*a*. Therefore, large trays 14, 14*a*** may be comprised of walls of varying height, quantity, and orientation.

As shown in greater detail in FIGS. 8-11, small tray 16 may include two opposing side panels 50, 52, a rear member 54, a front member 56 and a support 58. Right side panel 50, left side panel 52, and support 58 of small tray 16 are shown to be rectangular in shape, but may optionally be square instead. Small tray 16 may be made of a semi-transparent plastic, but may also be made of any material so long as the chosen material provides sufficient rigidity and strength for its intended purpose, may be manufactured inexpensively, and remains visually appealing to customers.

In the embodiment shown in FIGS. 8-11, support 58 is connected substantially perpendicular to inside wall surfaces 64, 65 of right side panel 50 and left side panel 52, respectively. Rear member 54, like rear fence 34, mounts to, and is substantially perpendicular to, top surface 59 of support 58 along rear edge 55 of support 58, and may be affixed to each of right side panel 50 and left side panel 52. In addition, small tray 16 may also include front member 56. As shown in the embodiment in FIGS. 8-11, front member 56 mounts to, and is substantially perpendicular to, top surface 59 of support 58 along front edge 57 of support 58, and may also be affixed to each of right side panel 50 and left side panel 52. It should be understood, however, that rear member 54 may only be affixed to one of the side panels 50, 52 or support 58, so long as rear member 54 forms a substantially rigid barrier between side panels 50, 52.

Support 58 may be vertically displaced a short distance from top surfaces 60, 61, 62, 63 of each of right side panel 50, left side panel 52, rear member 54 and front member 56, if present, respectively, to form four-sided lip 66. Support 58 together with four-sided lip 66 forms enclosed space 67, which is usable for supporting and displaying products for retail sale. The distance between top surfaces 60, 61, 62, 63 to support 58 may be varied to accommodate a wide range of product sizes.

Small tray 16 may or may not include front member 56 or rear member 54. If present, either or both of front member 56 and rear member 54 may mount on top of support 58, or may extend past support 58 to be approximately the same height as the two opposing side panels 50, 52 thereby forming at least three legs upon which small tray 16 may stand. Rear member 54 and front member 56 may also be of varying heights, so long as they do not exceed the height of the two opposing side panels 50, 52. Therefore, small tray 16 may be comprised of panels of varying height, quantity, and orientation.

Figure 13:
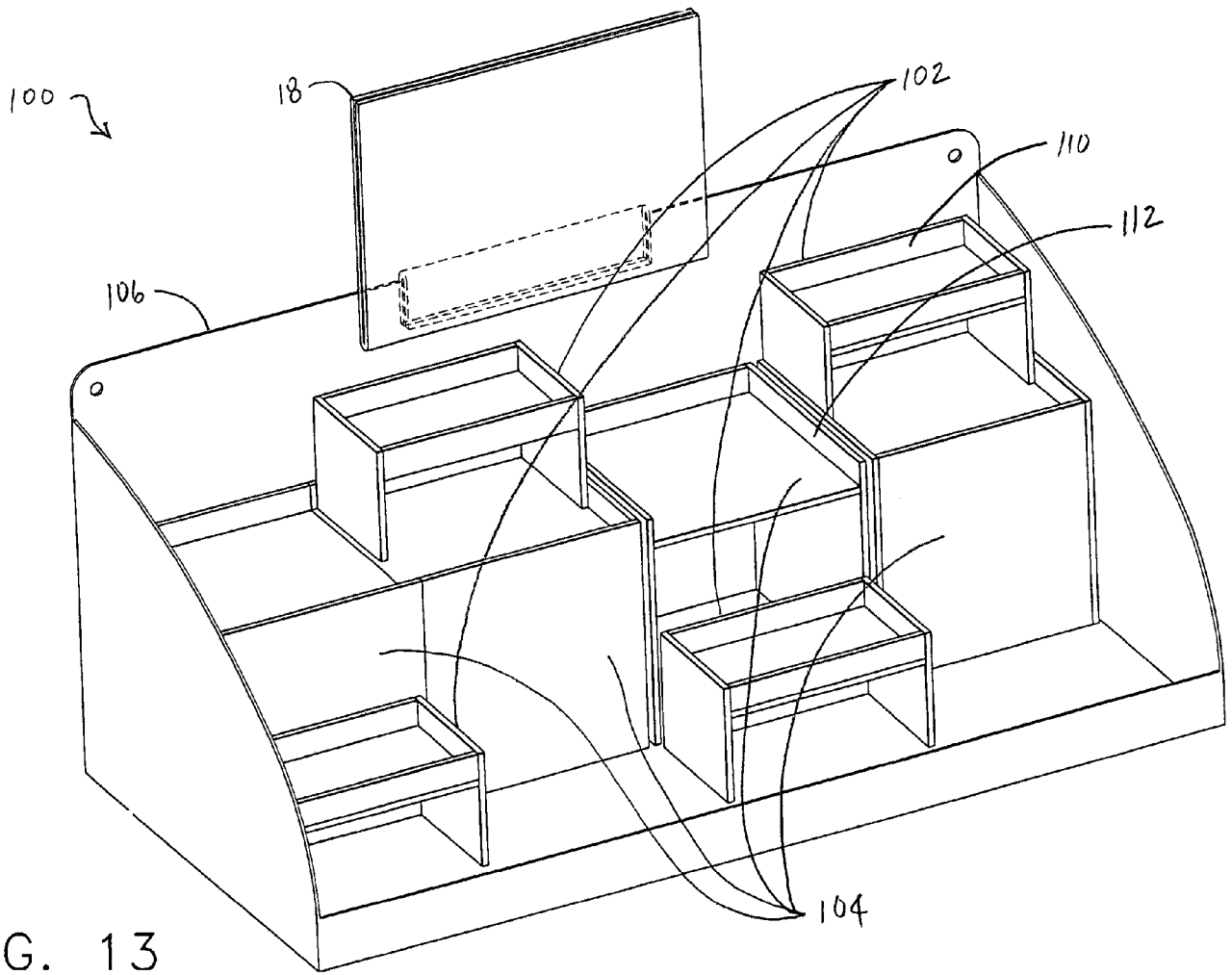
FIG. 13 illustrates a perspective view of yet another display configuration of the customizable display rack embodying the present invention with a rear fence that extends beyond the base.

FIG. 13 depicts another embodiment of the present invention. For example, display rack 100 shown in FIG. 13 includes a number of three-legged small trays 102, each having four-sided lip 110, and a number of two-legged large trays 104, each having a three-sided lip 112, installed in enclosure 106. FIG. 13, therefore, illustrates how various configurations of large trays 14/104 and small trays 16/102 can be intermixed together to form a display rack suitable for displaying a wide range of products having a variety of sizes and shapes.

While specific embodiments of the invention have been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

What is claimed is:

1. A display rack for displaying a plurality of differently-sized products, the display rack having two opposing side walls, a rear wall and a front wall, each wall extending from a bottom wall to form an enclosed space that is accessible from at least one side, and the front wall extending to a height that is substantially less than that of the rear wall, comprising:

a plurality of first trays sized to fit within the enclosed space formed by the display rack, wherein a predetermined number of first trays form a first row extending substantially the entire distance between each of the two opposing side walls of the display rack and a predetermined number of first trays form a second row extending substantially the entire distance between the front wall and the rear wall of the display rack, wherein each of the first trays are removably positionable in a plurality of orientations for displaying the plurality of differently sized products in the display rack, wherein each of the first trays comprise two substantially parallel, opposing first tray side walls connected to a base that extends substantially perpendicular between the opposing first tray side walls, the area of the opposing first tray side walls above the base forming an upper portion of each of the opposing first tray side walls, and a rear fence extending between the upper portion of each of the opposing first tray side walls and connecting to the base, wherein a combination of the upper portion of each of the opposing first tray side walls and the rear fence forms a three-sided lip with an open side, the display rack further comprising at least one second tray sized to fit within the area formed by the three-sided lip, wherein a predetermined number of second trays form a first row extending substantially the entire distance between each of the two opposing first tray side walls and wherein a predetermined number of second trays form a second row extending substantially the entire distance between the rear fence and the open side of each of the first trays.

2. The display rack described in claim 1, wherein the at least one second tray comprises two substantially parallel, opposing side panels connected by a support extending perpendicularly between the opposing side panels, and a rear member extending perpendicularly between the opposing side panels and perpendicularly to the support.

3. The display rack described in claim 2, wherein the opposing side panels and the rear member are the same height.

4. The display rack described in claim 3, wherein the area of the opposing side panels and the rear member extending above the support forms a second tray upper portion of each of the opposing side panels and the rear member.

5. The display rack described in claim 4, further comprising a front member extending between the second tray upper portion of each of the opposing side panels and connecting to the support.

6. The display rack described in claim 5, wherein a combination of the second tray upper portion of each of the two opposing side panels, the rear member, and the front member forms a second tray enclosed space for supporting products.

7. The display rack described in claim 2, wherein each of the two opposing side panels are approximately the same height with one another and the rear member having a height that is different from the height of each of the two opposing side panels, and wherein the support is affixed between the two opposing side panels and to an end of the rear member to form a three-sided product display tray having two legs.

8. The display rack described in claim 1, wherein the at least one second tray comprises two substantially parallel, opposing side panels connected by a support extending perpendicularly between the two opposing side panels, and further comprise a rear member and a front member, each of the rear member and the front member extending perpendicularly between the opposing side panels and perpendicularly to the support.

9. The display rack described in claim 8, wherein each of the two opposing side panels are approximately the same height with one another, the rear member and the front member are each approximately the same height with one another but different in height from each of the two opposing side panels, and wherein the support is affixed between the two opposing side panels and to an end of each of the rear member and of the front member to form an enclosed space defined by a four-sided lip.

10. A display rack for displaying a plurality of differently-sized products, the display rack having two opposing side walls, a rear wall and a front wall, each wall extending from a bottom wall to form an enclosed space that is accessible from at least one side, and the front wall extending to a height that is substantially less than that of the rear wall, comprising:

a plurality of first trays sized to fit within the enclosed space formed by the display rack, wherein a predetermined number of first trays form a first row extending substantially the entire distance between each of the two opposing side walls of the display rack and a predetermined number of first trays form a second row extending substantially the entire distance between the front wall and the rear wall of the display rack, wherein each of the first trays comprise two substantially parallel, opposing first tray side walls connected to a base that extends substantially perpendicular between the opposing first tray side walls, the area of the opposing first tray side walls above the base forming an upper portion of each of the opposing first tray side walls, and a rear fence extending between the upper portion of each of the opposing first tray side walls and connecting to the base, wherein a combination of the upper portion of each of the opposing first tray side walls and the rear fence forms a three-sided lip with an open side; and a plurality of second trays sized to fit within the area formed by the three-sided lip, wherein a predetermined number of second trays form a first row extending substantially the entire distance between each of the two opposing first tray side walls and wherein a predetermined number of second trays form a second row extending substantially the entire distance between the rear fence and the open side of each of the first trays, wherein each of the second trays comprise two parallel, opposing side panels connected by a support extending perpendicularly between the opposing side panels, and a rear member extending perpendicularly between the opposing side panels and perpendicularly to the support, wherein each of the two opposing side panels are approximately the same height with one another and the rear member having a height that is different from the height of each of the two opposing side panels, and wherein the support is affixed between the two opposing side panels and to an end of the rear member to form a three-sided product display tray having two legs.

* * * * *